US008312649B2

(12) United States Patent
Wagger et al.

(10) Patent No.: US 8,312,649 B2
(45) Date of Patent: Nov. 20, 2012

(54) ROTARY SNOW TILLER FOR GROOMING SKI SLOPES AND RELATIVE OPERATING METHOD

(75) Inventors: Klaus Wagger, Brunico (IT); Jan Müller, Vipiteno (IT)

(73) Assignee: Rolic Invest SARL, Luxembourg (LU)

( * ) Notice: Subject to any disclaimer, the term of this patent is extended or adjusted under 35 U.S.C. 154(b) by 165 days.

(21) Appl. No.: 12/678,012

(22) PCT Filed: Sep. 12, 2008

(86) PCT No.: PCT/EP2008/062210

§ 371 (c)(1), (2), (4) Date: Sep. 7, 2010

(87) PCT Pub. No.: WO2009/034184

PCT Pub. Date: Mar. 19, 2009

(65) Prior Publication Data

US 2011/0005106 A1 Jan. 13, 2011

(30) Foreign Application Priority Data

Sep. 14, 2007 (IT) ..... MI2007A1775

(51) Int. Cl.
*E01H 5/04* (2006.01)

(52) U.S. Cl. ..... 37/223

(58) Field of Classification Search ..... 37/219–225, 37/465, 196, 452, 246, 248; 172/112, 713, 172/772.5, 540; 299/39.8; 404/121; 241/292.1, 241/293

See application file for complete search history.

(56) References Cited

U.S. PATENT DOCUMENTS

| | | | | |
|---|---|---|---|---|
| 5,581,914 | A * | 12/1996 | Sinykin | 37/223 |
| 6,671,983 | B2 * | 1/2004 | Quenzi et al. | 37/222 |
| 2003/0159840 | A1 | 8/2003 | Schmidt, Jr. | |

FOREIGN PATENT DOCUMENTS

| | | | |
|---|---|---|---|
| AT | 500 034 | A | 10/2005 |
| CA | 2120207 | A | 12/1995 |
| CA | 2210539 | A | 7/1996 |
| DE | 1 534 252 | A | 3/1970 |
| DE | 296 00 905 | U | 5/1996 |
| GB | 1119803 | A | 7/1968 |
| JP | 2-139914 | U | 11/1990 |

* cited by examiner

*Primary Examiner* — Robert Pezzuto
(74) *Attorney, Agent, or Firm* — Frommer Lawrence & Haug LLP; Ronald R. Santucci

(57) ABSTRACT

A rotary snow tiller, for grooming the snow surface of ski slopes and designed to advance in a travelling direction, has a frame; a shaft rotating about an axis transverse to the travelling direction, and having teeth for breaking up the snow surface; a further shaft located behind the shaft, rotating about a further axis transverse to the travelling direction, and having further teeth for further breaking up the snow surface; and a finish mat located behind the further shaft.

18 Claims, 3 Drawing Sheets

ROTARY SNOW TILLER FOR GROOMING SKI SLOPES AND RELATIVE OPERATING METHOD

This application is a 371 of PCT/EP2008/062210 filed on Sep. 12, 2008, published on Mar. 19, 2009 under publication number WO 2009/034184 A which claims priority benefits of Italian Patent Application No. MI2007A 001775 filed Sep. 14, 2007, the disclosure of which is hereby incorporated by reference.

TECHNICAL FIELD

The present invention relates to a rotary snow tiller for grooming ski slopes.

BACKGROUND ART

A rotary snow tiller for grooming ski slopes normally advances in a travelling direction, and comprises a frame; and a shaft rotating about an axis transverse to the travelling direction, and having teeth for breaking up the snow surface.

Known rotary snow tillers of the above type have proved particularly effective in grooming ski slopes.

They are not so effective, however, when deep-down tilling of the snow surface is required, on account of the high energy consumption level involved.

DISCLOSURE OF INVENTION

It is an object of the present invention to provide a rotary snow tiller for grooming ski slopes, designed to eliminate the drawbacks of the known art in a straightforward, low-cost manner, and which in particular provides for excellent grooming of the snow surface in any condition, without consuming an excessive amount of energy.

According to the present invention, there is provided a rotary snow tiller for grooming the snow surface of ski slopes and designed to advance in a travelling direction, the rotary snow tiller comprising a frame; and a shaft rotating about an axis transverse to the travelling direction, and having teeth for breaking up the snow surface; the rotary snow tiller being characterized by comprising at least one further shaft located behind said shaft, rotating about a further axis transverse to the travelling direction, and having further teeth for further breaking up the snow surface.

By virtue of the present invention, even deep-down tilling can be performed without consuming an excessive amount of energy.

The present invention also relates to a method of operating a rotary snow tiller for grooming ski slopes.

According to the present invention, there is provided a method of operating a rotary snow tiller as claimed in any one of Claims 1 to 14, the method comprising the steps of rotating the shaft about the axis by means of a respective rotary actuator, and rotating the further shaft about the further axis by means of a respective further rotary actuator.

BRIEF DESCRIPTION OF THE DRAWINGS

A number of non-limiting embodiments of the present invention will be described by way of example with reference to the accompanying drawings, in which.

BEST MODE FOR CARRYING OUT THE INVENTION

Figure 1:
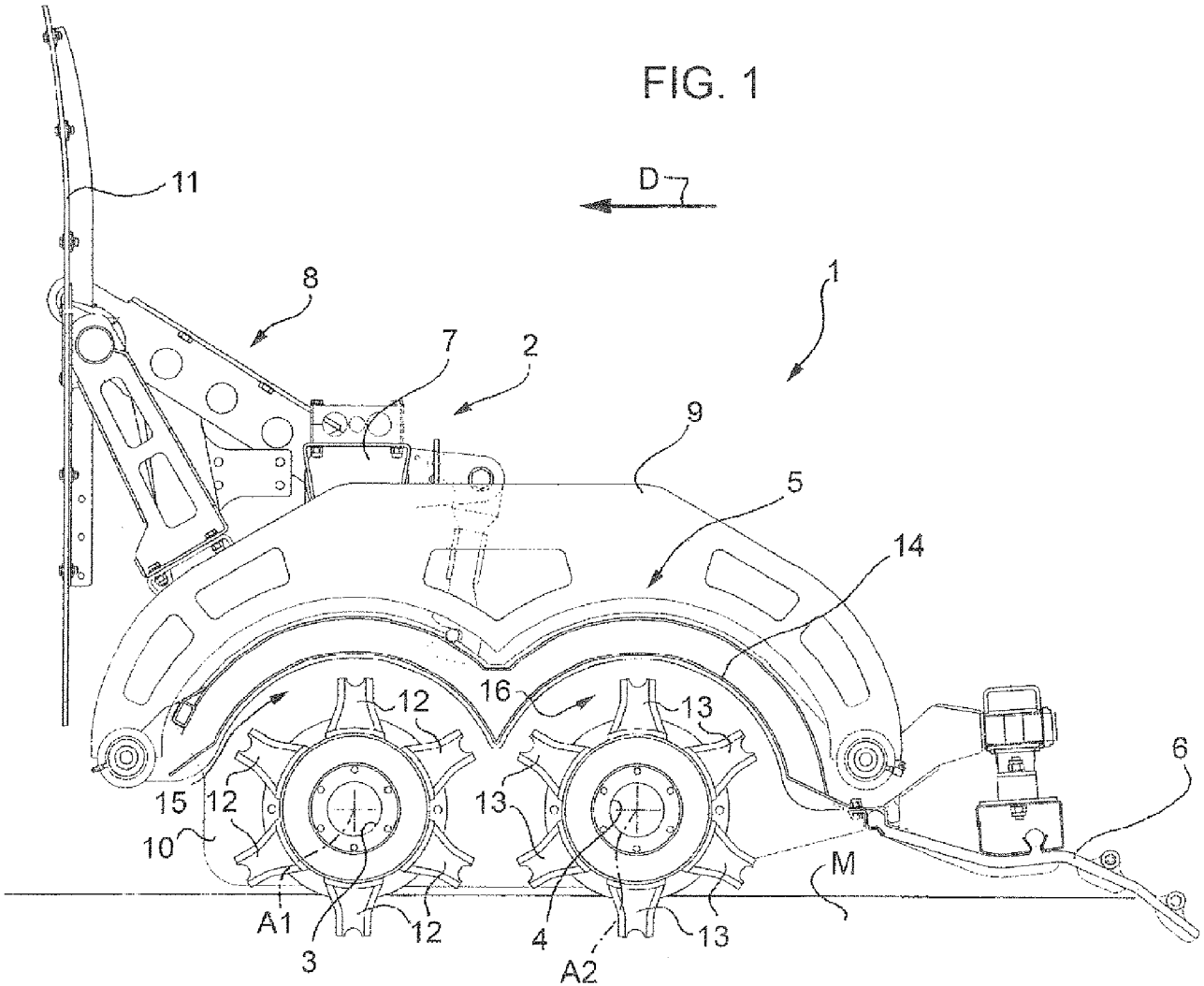
FIG. 1 shows a partly sectioned side view, with parts removed for clarity, of a rotary snow tiller in accordance with the present invention.

Number 1 in FIG. 1 indicates as a whole a rotary snow tiller for grooming the snow surface M of ski slopes, and which is towed in direction D by a snow groomer vehicle not shown in the drawings.

Rotary snow tiller 1 provides for breaking up a surface portion of snow surface M, and comprises a frame 2; a shaft 3 mounted to rotate with respect to frame 2 about an axis A1, and extending transverse to travelling direction D; a shaft 4 transverse to travelling direction D, located behind shaft 3 in travelling direction D, and mounted to rotate with respect to frame 2 about an axis A2; a protective casing 5 surrounding shafts 3 and 4; and a normally flexible mat 6 which is connected to casing 5, extends behind shaft 4, and is drawn over the surface of the tilled snow surface M.

Frame 2 comprises a bar 7 parallel to axis A1; a hitch device 8 fixed to bar 7 and for connecting tiller 1 to the snow groomer vehicle (not shown in the drawings); two arc-shaped segments 9 fixed to and transverse to bar 7; and plates 10 (only one shown in FIG. 1) for supporting shafts 3 and 4 by means of bearings not shown in the drawings.

Tiller 1 comprises two adjustable panels 11 which have the purpose to protect, to a certain extent, the tiller 1 from the snow thrown up by the groomer vehicle not shown in the drawings.

Shaft 3 comprises a number of teeth 12 equally spaced about and along axis A1, and each of which projects radially from shaft 3 to penetrate snow surface M.

The length of shaft 3 defines the work range and the width of tiller 1 as a whole.

Shaft 4 comprises a number of teeth 13 equally spaced about and along axis A2, and each of which projects radially from shaft 4 to penetrate snow surface M. The length of shaft 4 substantially equals the length of shaft 3, and defines the work range and the width of tiller 1 as a whole.

Casing 5 is substantially defined by a wall 14 which extends beneath arc-shaped segments 9 and surrounds shafts 3 and 4. In the FIG. 1 example, the casing comprises two housings 15, 16 partly housing respective shafts 3, 4.

Teeth 12 and 13 are equal in size and number, and are preferably arranged in a spiral about respective shafts 3 and 4.

Figure 2:
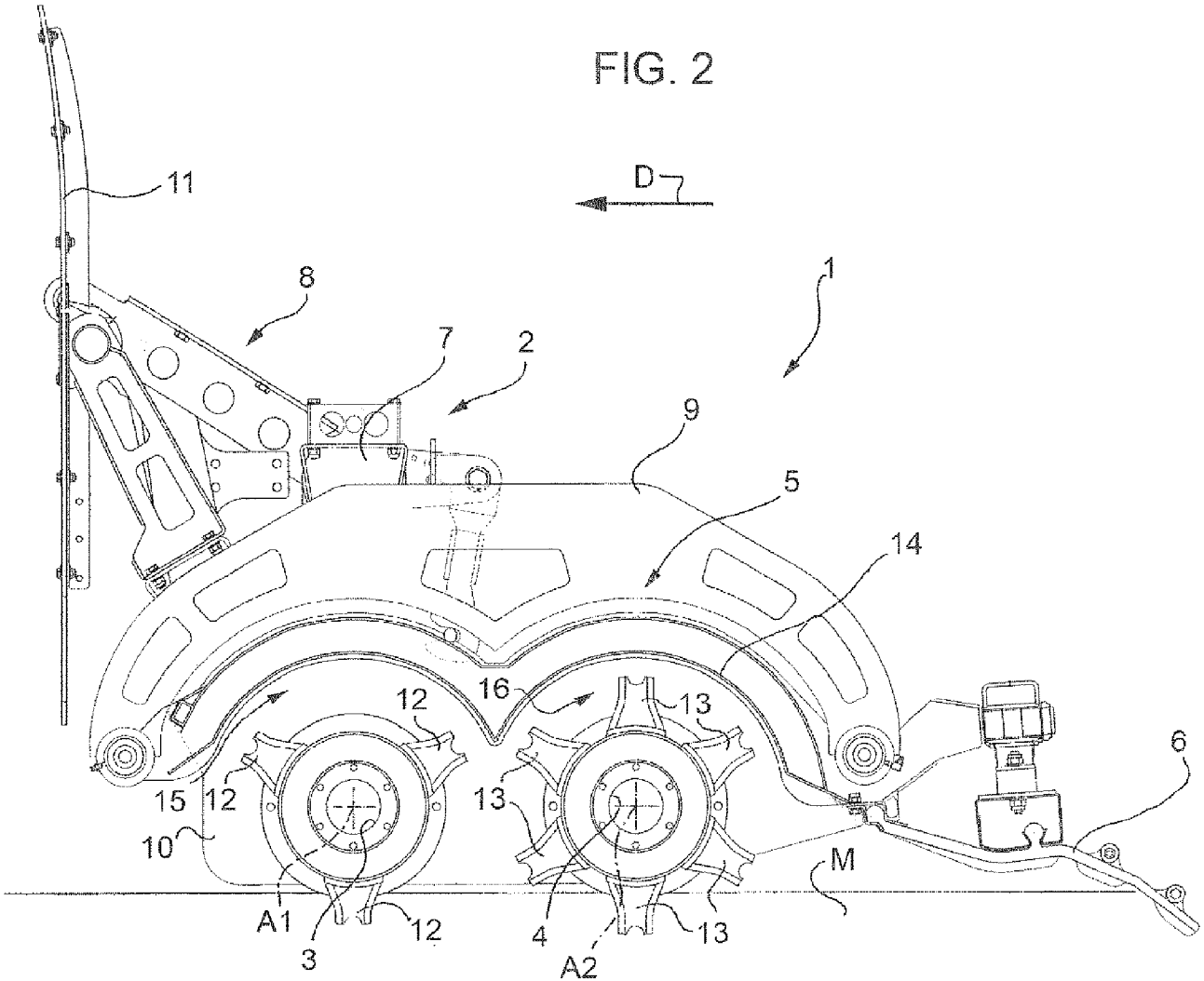
FIG. 2 shows a partly sectioned side view, with parts removed for clarity, of a rotary snow tiller in accordance with a variation of the present invention.

In the FIG. 2 variation, teeth 12 of shaft 3 are fewer in number than teeth 13 of shaft 4.

Teeth 12 of shaft 3 are also shorter in length than teeth 13 of shaft 4.

The above features are designed to till a first layer of snow surface M relatively roughly, and to till a second layer, deeper than the first layer, more finely.

Other variations are possible. For example: teeth 12 may be shorter in length than but equal in number to teeth 13; or teeth 12 and 13 may be the same length, but teeth 12 fewer in number than teeth 13.

Figure 3:
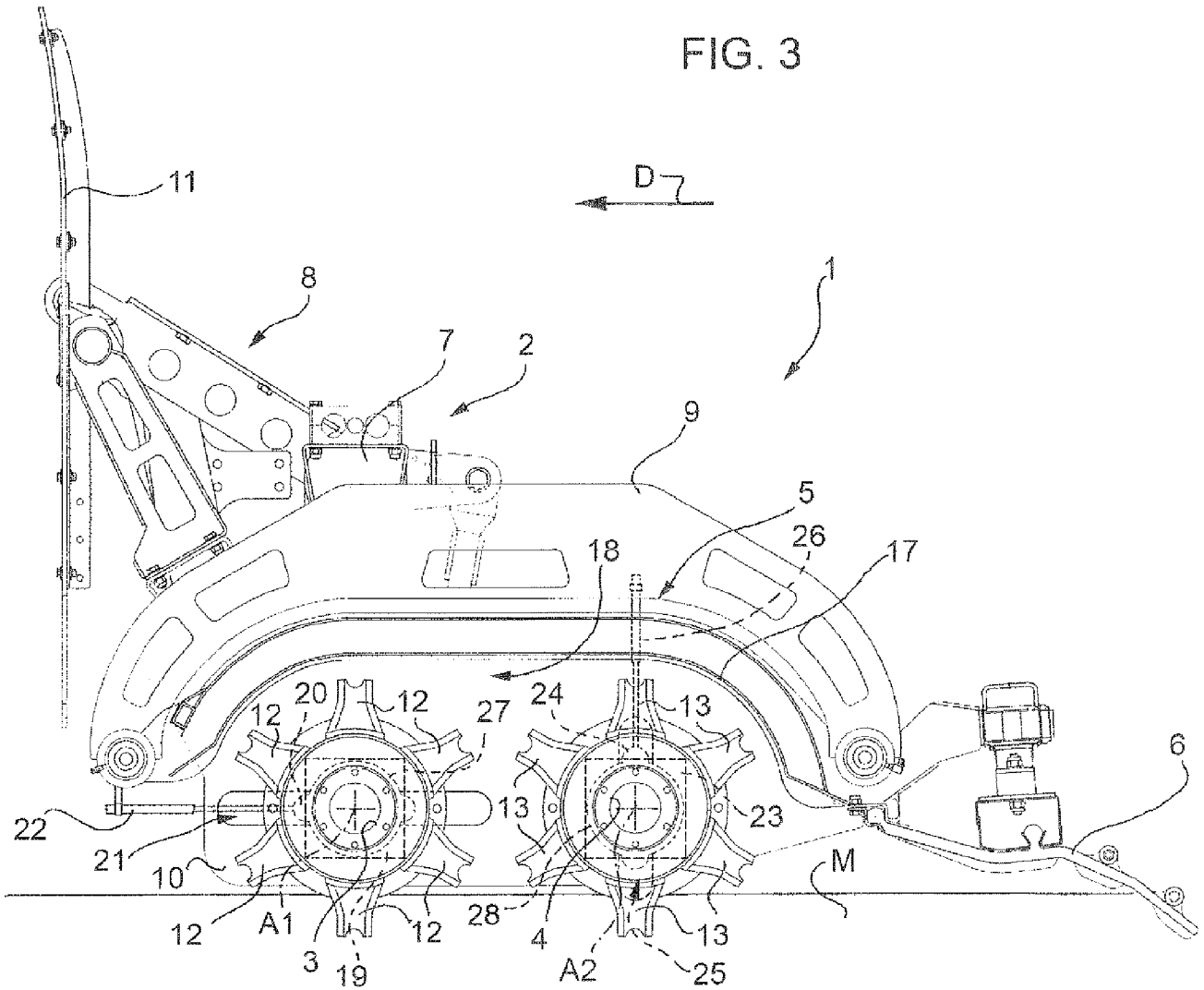
FIG. 3 shows a partly sectioned side view, with parts removed for clarity, of a rotary snow tiller in accordance with a variation of the present invention.

In the FIG. 3 variation, casing 5 comprises a wall 17 forming a single housing 18 housing both shafts 3 and 4.

Shafts 3 and 4 are supported movably with respect to frame 2, i.e. can be translated into different relative positions. In the case in point, shafts 3 and 4 are fitted translatably to supporting plates 10. In the FIG. 3 example, shaft 3 is supported at the ends by blocks 19 (only one shown in FIG. 3) each of which have a sliding member 20 engaging a guide 21 which, in the example shown, is a slot parallel to travelling direction D.

Sliding member 20 is connected to a respective actuator 22 for adjusting the position of shaft 3.

Similarly, shaft 4 is supported at the ends by blocks 23 (only one shown in FIG. 3) which have a sliding member 24 engaging a guide 25 which, in the example shown, is a slot transverse to travelling direction D, and in particular a vertical slot.

Sliding member 24 is connected to an actuator 26 for adjusting the position of shaft 4.

The relative working depth of the two shafts 3 and 4 can thus be adjusted (the absolute depth is adjusted by known devices for adjusting the position of bar 7 with respect to hitch device 8), and the distance between shafts 3 and 4 can be increased and reduced by adjusting the position of shaft 3, to mesh teeth 12 and 13.

Shafts 3 and 4 are rotated operationally by respective rotary actuators 27 and 28, which, in the example shown, are hydraulic. According to the present invention, hydraulic actuators 27 and 28 are rotated in the same direction: shafts 3 and 4 are rotated about respective axes A1 and A2 in the same direction, preferably clockwise in the attached drawings, so that teeth 12 and 13 penetrate snow surface M in substantially the same direction as travelling direction D.

In one operating mode, shafts 3 and 4 are rotated at different speeds: preferably, shaft 3 is rotated at a slower speed than shaft 4.

In a further operating mode, shafts 3 and 4 are rotated in opposite directions about respective axes A1 and A2.

Rotary snow tiller 1 can be configured and operated in different modes to adapt to different characteristics, and provide the best solution for each type, of snow surface M.

The invention claimed is:

1. A rotary snow tiller for grooming the snow surface of ski slopes and designed to advance in a travelling direction, the rotary snow tiller comprising a frame; and a powered shaft rotating about an axis transverse to the travelling direction, and having teeth for tilling a layer of the snow surface; the rotary snow tiller comprising at least one further powered shaft located behind said shaft, rotating about a further axis transverse to the travelling direction, and having further teeth for further tilling said layer and tilling a further layer of the snow surface below said layer, wherein the further teeth are longer than said teeth.

2. A rotary snow tiller as claimed in claim 1, comprising a finish mat; said further shaft being located between said shaft and said finish mat.

3. A rotary snow tiller as claimed in claim 1, wherein the further shaft has a number of further teeth greater than the number of teeth of the shaft.

4. A rotary snow tiller as claimed in claim 1, wherein the shaft is supported to translate with respect to said frame.

5. A rotary snow tiller as claimed in claim 1, wherein the further shaft is supported to translate with respect to said frame.

6. A rotary snow tiller as claimed in claim 4, wherein the shaft is mounted in a block in turn mounted in sliding manner inside a guide associated with said frame, to adjust the position of the shaft.

7. A rotary snow tiller as claimed in claim 6, wherein said guide is horizontal.

8. A rotary snow tiller as claimed in claim 5, comprising an actuator connected to said block to adjust the position of the shaft.

9. A rotary snow tiller as claimed in claim 5, wherein the further shaft is mounted in a further block in turn mounted in sliding manner inside a further guide associated with said frame, to adjust the position of the further shaft.

10. A rotary snow tiller as claimed in claim 8, wherein said further guide is vertical.

11. A rotary snow tiller as claimed in claim 10, comprising a further actuator to adjust the position of the further shaft.

12. A rotary snow tiller as claimed in claim 1, comprising a casing over the shaft and the further shaft; the casing forming a housing for partly housing the shaft, and a further housing adjacent to the housing and for partly housing the further shaft.

13. A rotary snow tiller as claimed in claim 1, comprising a casing over the shaft and the further shaft; the casing forming a single housing for partly housing the shaft and the further shaft.

14. A method of operating a rotary snow tiller as claimed in claim 1, the method comprising the steps of rotating the shaft about the axis by means of a respective rotary actuator, and rotating the further shaft about the further axis by means of a respective further rotary actuator.

15. A method as claimed in claim 14, which includes rotating the shaft and the further shaft in the same direction.

16. A method as claimed in claim 14, which includes rotating the shaft and the further shaft in different directions.

17. A method as claimed in Claim 14, which includes rotating the shaft and the further shaft at different respective speeds.

18. A rotary snow tiller for grooming the snow surface of ski slopes and designed to advance in a travelling direction, the rotary snow tiller comprising a frame; and a powered shaft rotating about an axis transverse to the travelling direction, and having teeth for tilling a layer of the snow surface; the rotary snow tiller comprising at least one further powered shaft located behind said shaft and of the same length of said shaft, rotating about a further axis transverse to the travelling direction, and having further teeth for further tilling said layer of the snow surface, wherein the number of further teeth is greater than the number of the teeth.

* * * * *